US007663275B2

(12) United States Patent
McGill et al.

(10) Patent No.: US 7,663,275 B2
(45) Date of Patent: Feb. 16, 2010

(54) LINEAR COMPRESSOR CONTROLLER

(75) Inventors: Ian Campbell McGill, Auckland (NZ); Zhuang Tian, Auckland (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 425 days.

(21) Appl. No.: 11/226,675

(22) Filed: Sep. 14, 2005

(65) Prior Publication Data

US 2006/0070518 A1 Apr. 6, 2006

Related U.S. Application Data

(60) Provisional application No. 60/615,502, filed on Oct. 1, 2004.

(51) Int. Cl.
*H02K 11/00* (2006.01)

(52) U.S. Cl. ..... 310/68 R; 310/12; 310/13; 310/14; 310/15; 318/114; 318/119; 318/135

(58) Field of Classification Search ..... 310/12–15; 318/135, 114, 119
See application file for complete search history.

(56) References Cited

U.S. PATENT DOCUMENTS

| | | | | |
|---|---|---|---|---|
| 3,329,334 | A | 7/1967 | Curwen | |
| 4,602,174 | A | 7/1986 | Redlich | |
| 5,789,895 | A * | 8/1998 | Lee | 318/811 |
| 5,909,095 | A * | 6/1999 | Sakti et al. | 318/400.35 |
| 6,176,683 | B1 * | 1/2001 | Yang | 417/44.1 |
| 6,252,364 | B1 * | 6/2001 | Chiang et al. | 318/280 |
| 6,289,680 | B1 * | 9/2001 | Oh et al. | 62/6 |
| 6,437,524 | B1 | 8/2002 | Dimanstein | |
| 6,534,938 | B1 * | 3/2003 | Wu et al. | 318/400.28 |
| 6,536,326 | B2 * | 3/2003 | Unger et al. | 91/361 |
| 6,710,573 | B2 * | 3/2004 | Kadah | 318/727 |
| 6,811,380 | B2 * | 11/2004 | Kim | 417/44.1 |
| 6,960,893 | B2 * | 11/2005 | Yoshida et al. | 318/127 |
| 7,138,776 | B1 * | 11/2006 | Gauthier et al. | 318/400.34 |
| 7,288,911 | B2 * | 10/2007 | MacKay | 318/400.21 |
| 2003/0173834 | A1 * | 9/2003 | McGill et al. | 310/12 |
| 2004/0222779 | A1 * | 11/2004 | Cock et al. | 324/76.77 |

FOREIGN PATENT DOCUMENTS

| | | |
|---|---|---|
| EP | 0 726 394 | 8/1996 |
| WO | WO00/26536 | 5/2000 |
| WO | WO00/79671 | 12/2000 |

(Continued)

OTHER PUBLICATIONS

AN1130.pdf (ST Microelectronics Application Note, 2000).*

(Continued)

*Primary Examiner*—Quyen Leung
*Assistant Examiner*—John K Kim
(74) *Attorney, Agent, or Firm*—Trexler, Bushnell, Giangiorgi, Blackstone & Marr, Ltd.

(57) ABSTRACT

A sensorless method and apparatus for detecting piston collisions in a free piston linear compressor motor. The waveform of the back EMF induced in the motor stator windings is analysed for slope discontinuities and other aberrations in a time window centred on the back EMF zero-crossings. Waveform slope artefacts are indicative of piston collisions and cause the motor power to be decremented in response.

12 Claims, 6 Drawing Sheets

FOREIGN PATENT DOCUMENTS

| | | |
|---|---|---|
| WO | WO01/29444 | 4/2001 |
| WO | WO01/79671 | 10/2001 |
| WO | WO02/35093 | 5/2002 |
| WO | WO03/044365 | 5/2003 |
| WO | 2006/038817 | 4/2006 |

OTHER PUBLICATIONS

AN1103.pdf (ST Microelectronics Application Note, 2001).*
ST72141s.pdf (ST Microelectronics MCU ST 72141 Datasheet, 2002).*

* cited by examiner

LINEAR COMPRESSOR CONTROLLER

This application is a non provisional of U.S. provisional patent application Ser. No. 60/615,502, entitled "Linear Compressor Controller", filed on Oct. 1, 2004 and is hereby incorporated by reference.

FIELD OF INVENTION

This invention relates to a controller for a linear motor used for driving a compressor and in particular but not solely a refrigerator compressor.

SUMMARY OF THE PRIOR ART

Linear compressor motors operate on a moving coil or moving magnet basis and when connected to a piston, as in a compressor, require close control on stroke amplitude since unlike compressors employing a crank shaft stroke amplitude is not fixed. The application of excess motor power for the conditions of the fluid being compressed may result in such a free piston colliding with the cylinder head in which it is located.

In International Patent Publication no. WO01/79671 the applicant has disclosed a control system for free piston compressor which limits motor power as a function of property of the refrigerant entering the compressor. However in this and other free piston refrigeration systems overshoot of the piston may occur despite other measures and it may be useful to detect an actual piston collision and then to reduce motor power in response. Such a strategy could be used purely to prevent compressor damage, when excess motor power occurred for any reason. It could also be used as a way of ensuring high volumetric efficiency. Specifically in relation to the latter, a compressor could be driven with power set to just less than to cause piston collisions, to ensure the piston operated with minimum head clearance volume. Minimising head clearance volume leads to increased volumetric efficiency.

U.S. Pat. No. 6,536,326 discloses a control system for free piston machines which includes a feedback signal to reduce piston drive power when mechanical vibration due to piston-cylinder head collision are detected. A sensor such as a microphone is used to detect the mechanical vibrations.

In the prior art up until WO03/044365 discrete component sensors have been required to detect piston collisions. While WO03/044365 discloses measuring successive half stroke times and detecting a change it would be desirable if other sensorless techniques were available.

SUMMARY OF THE INVENTION

It is an object of the present invention to provide a linear motor controller which goes someway to achieving the above mentioned desiderata.

Accordingly in one aspect the invention consists in a method of controlling the stroke of a free piston linear compressor motor so as to minimise or avoid piston collisions at the extremities of said stroke. The method includes the steps of:

monitoring the motor back EMF, detecting zero-crossings of said motor back EMF, monitoring the slope of the back EMF waveform in the vicinity of said zero crossings, detecting discontinuities in waveform slope, and incrementally reducing motor input power upon detection of a slope discontinuity.

In a second aspect the invention consists in a free piston linear compressor motor having a stroke controlled so as to minimise or avoid piston collisions at the extremities of said stroke. The motor has a wound stator and a co-acting armature which is mechanically coupled to said piston. Means are provided to monitor the motor back EMF in the stator windings. A zero crossing detector means detects zero-crossings of the monitored back EMF. There are also means for determining the slope of the back EMF waveform in the vicinity of the detected zero crossings, and for determining discontinuities in the back EMF waveform slope. A motor input power controller supplies current to stator windings and reduces motor input power upon a slope discontinuity being determined.

Preferably said slope monitoring comprises measuring and storing the value of the back EMF at predetermined intervals and calculating the slope of the back EMF waveform between successive predetermined intervals to produce succession of slope values.

Preferably said slope monitoring comprises comparing the latest measured slope with the measured slope at the same point in the immediately preceding cycle.

Preferably said slope monitoring comprises comparing the latest measured slope with the average of the measured slopes at the same point of a predetermined number of immediately preceding cycles.

Preferably said discontinuities in back EMF waveform slope are detected by successively comparing each said calculated slope values with a predetermined value and if said predetermined value is exceeded over a predetermined number of slope values indicating a slope discontinuity.

Preferably said back EMF slope discontinuities which are detected are those which represent an increase in slope on rising back EMF and a decrease in slope on falling back EMF.

Preferably said back EMF slope discontinuities which are detected are those which represent an increase in slope on a falling back EMF.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples.

BRIEF DESCRIPTION OF THE DRAWINGS

Examples of the invention will now be described with reference to the accompanying drawings in which.

DESCRIPTION OF THE PREFERRED EMBODIMENTS

The present invention provides methods detecting piston head collisions in a free piston reciprocating compressor powered by a linear motor. One such is the type shown in FIG. 1. This motor configuration has a reduced size compared to the conventional linear motor of the type described in U.S. Pat. No. 4,602,174. The reduced size keeps the efficiency high at low to medium power output at the expense of slightly reduced efficiency at high power output. This is an acceptable compromise for a compressor in a household refrigerator which runs at low to medium power output most of the time and at high power output less than 20% of the time (this occurs during periods of frequent loading and unloading of the refrigerator contents or on very hot days).

While in the following description the various embodiments of the present invention are described in relation to a cylindrical linear motor it should be appreciated that these methods are equally applicable to linear motors in general and in particular also to flat linear motors, see for example WO 02/35093, the content of which are incorporated herein by reference. One skilled in the art would require no special effort to apply the control strategy herein described to any form of linear motor.

Figure 1:
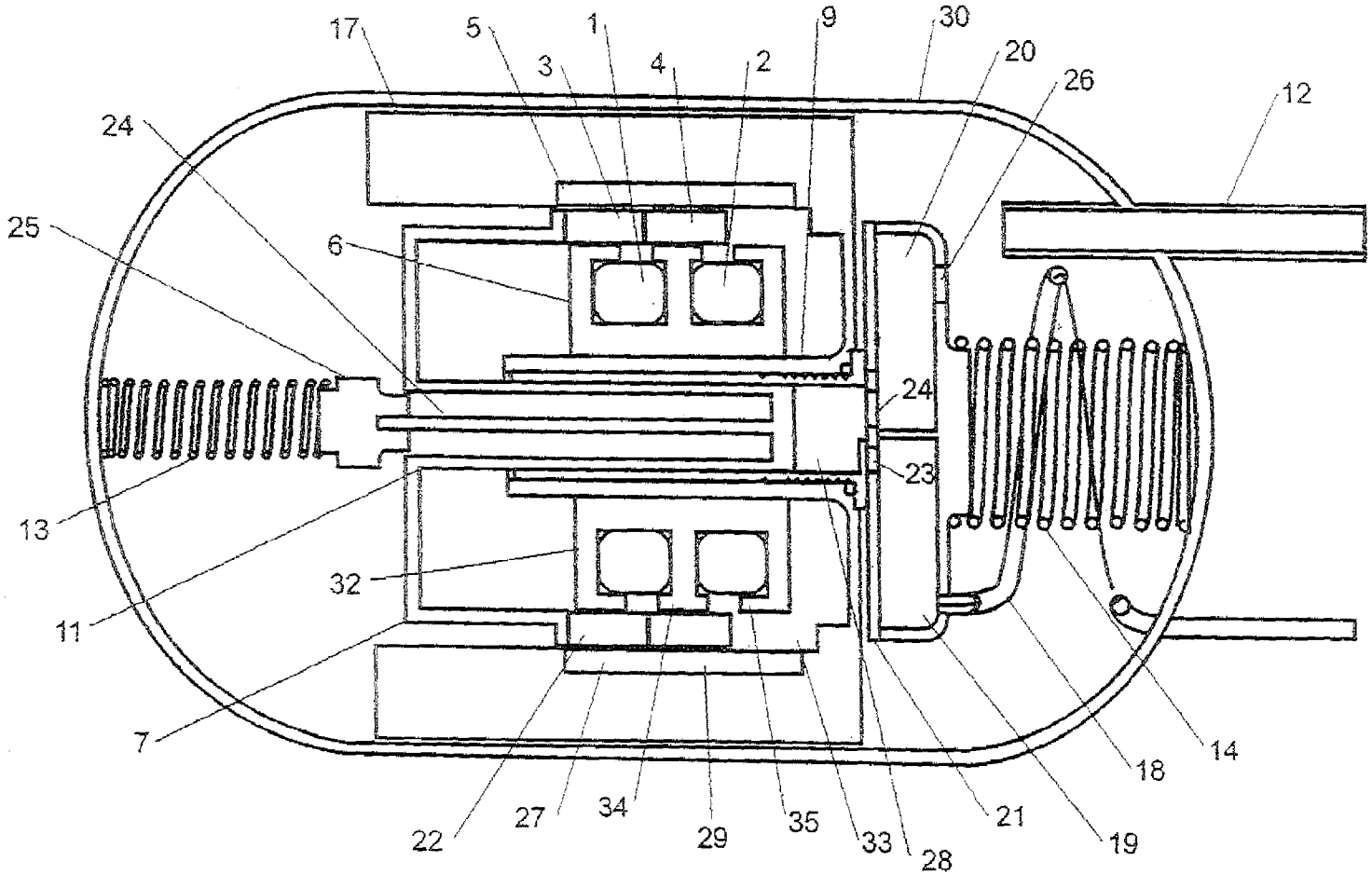
FIG. 1 is a diagrammatic longitudinal section of a linear compressor controlled according to the present invention.

The compressor shown in FIG. 1, involves a permanent magnet linear motor connected to a reciprocating free piston compressor. The cylinder 9 is supported by a cylinder spring 14 within the compressor shell 30. The piston 11 is supported radially by the bearing formed by the cylinder bore plus its spring 13 via the spring mount 25. The bearings may be lubricated by any one of a number of methods as are known in the art, for example the gas bearing described in WO 01/29444 or the oil bearing described in WO 00/26536, the contents of both of which are incorporated herein by reference. Equally the present invention is applicable to alternative reciprocation systems. For example while below a compressor is described with a combined gas/mechanical spring system, the embodiments of the present invention can be used with an entirely mechanical or entirely gas spring system.

The reciprocating movement of piston 11 within cylinder 9 draws gas in through a suction tube 12 through a suction port 26 through a suction muffler 20 and through a suction valve port 24 in a valve plate 21 into a compression space 28. The compressed gas then leaves through a discharge valve port 23, is silenced in a discharge muffler 19, and exits through a discharge tube 18.

The compressor motor comprises a two part stator 5,6 and an armature 22. The force which generates the reciprocating movement of the piston 11 comes from the interaction of two annular radially magnetised permanent magnets 3,4 in the armature 22 (attached to the piston 11 by a flange 7), and the magnetic field in an air gap 33 (induced by the stator 6 and coils 1,2).

A two coil version of the compressor motor is shown in FIG. 1, which has a current flowing in coil 1, which creates a flux that flows axially along the inside of the stator 6, radially outward through the end stator tooth 32, across the air gap 33, then enters the back iron 5. Then it flows axially for a short distance 27 before flowing radially inwards across the air gap 33 and back into the centre tooth 34 of the stator 6. The second coil 2 creates a flux which flows radially in through the centre tooth 34 across the air gap axially for a short distance 29, and outwards through the air gap 33 into the end tooth 35. The flux crossing the air gap 33 from tooth 32 induces an axial force on the radially magnetised magnets 3,4 provided that the magnetisation of the magnet 3 is of the opposite polarity to the other magnet 4. It will be appreciated that instead of the back iron 5 it would be equally possible to have another set of coils on the opposite sides of the magnets.

An oscillating current in coils 1 and 2, not necessarily sinusoidal, creates an oscillating force on the magnets 3,4 that will give the magnets and stator substantial relative movement which is most efficient when the oscillation frequency is close to the natural frequency of the mechanical system. This natural frequency is determined by the stiffness of the springs 13, 14 and mass of the cylinder 9 and stator 6. The oscillating force on the magnets 3, 4 creates a reaction force on the stator parts. Thus the stator 6 must be rigidly attached to the cylinder 9 by adhesive, shrink fit or clamp etc. The back iron is clamped or bonded to the stator mount 17. The stator mount 17 is rigidly connected to the cylinder 9.

Experiments have established that a free piston compressor is most efficient when driven at the natural frequency of the compressor piston-spring system of the compressor. However as well as any deliberately provided metal spring, there is an inherent gas spring, the effective spring constant of which, in the case of a refrigeration compressor, varies as either evaporator or condenser pressure varies. The electronically commutated permanent magnet motor already described, is controlled using techniques including those derived from the applicant's experience in electronically commutated permanent magnet motors as disclosed in WO 01/79671 for example, the contents of which are incorporated herein by reference.

When a linear motor is controlled as described in WO01/79671 it is possible that the compressor input power increases to a level where the excursion of the piston (11, FIG. 1) results in a collision with the head of cylinder (9, FIG. 1).

The present invention detects the onset of such collisions, or even when a collision is about to occur from the shape of the motor back EMF waveform.

When a collision is detected the magnitude of the motor current is reduced. The reductions to the current and thus input power to the motor are reduced incrementally. Once the collisions stop, the current value is allowed to slowly increase to its previous value over a period of time. Preferably the period of time is approximately 1 hour. Alternatively the current will remain reduced until the system variables change significantly. In one embodiment where the system in WO01/79671 is used as the main current controller algorithm, such a system change might be monitored by a change in the ordered maximum current. In that case it would be in response to a change in frequency or evaporator temperature. In the preferred application of the present invention it is envisaged that the WO 01/79671 algorithm be used with the present invention providing a supervisory role which would lead to an improved volumetric efficiency over the prior art.

Figure 2:
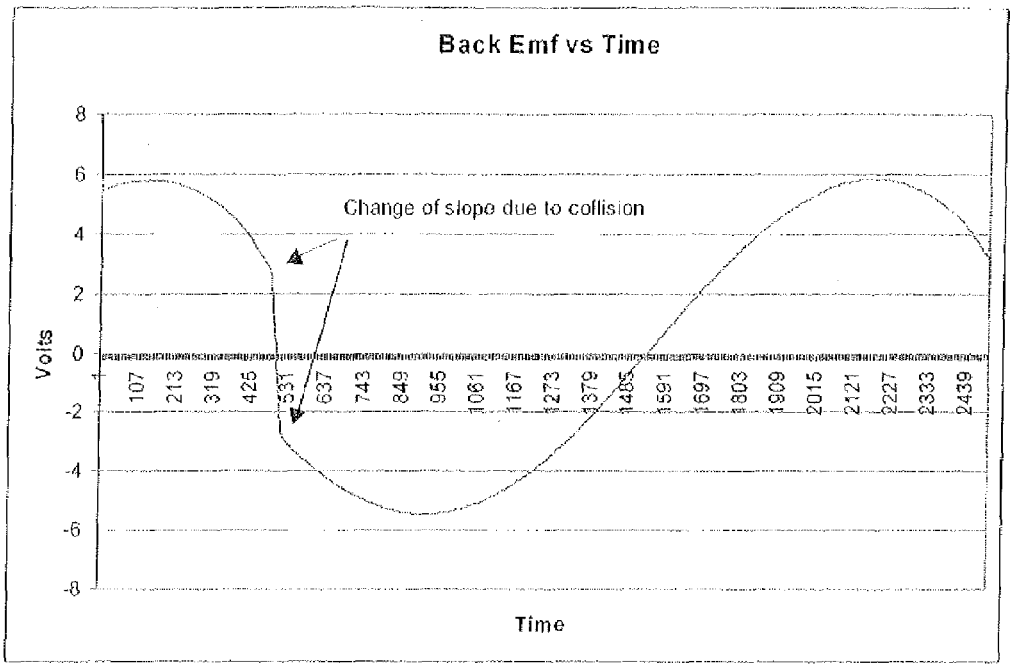
FIG. 2 is a graph of compressor motor back EMF versus time.
Figure 3:
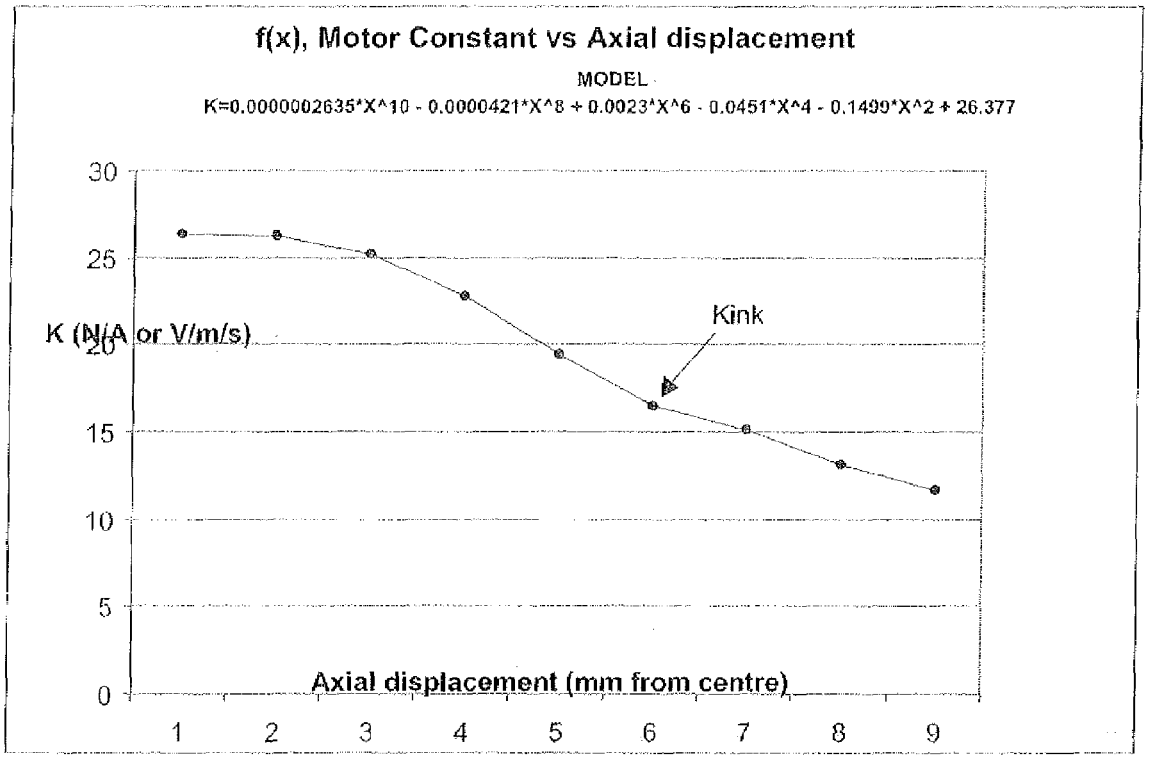
FIG. 3 is a graph or motor "constant" versus axial displacement of the piston for a short stator motor.

The physical phenomena from which the present invention resides will now be outlined with reference to FIGS. 2 and 3.

When the piston moving at a velocity, $v$, hits the cylinder head (assuming it is made from the same material), an elastic stress wave is propagated with a magnitude, $\sigma_i$, determined by the relation $$\sigma_i = v\sqrt{\rho_i \cdot E}$$

where $\rho_i$ and E are the density and Young's Modulus respectively of the piston cylinder material.

The stress, $\sigma_i$, acts on the contact area, $A_i$ for a length of time determined by the time it takes for the stress wave to travel the length or the piston and return after reflecting at the far end. Therefore there is a force, $F_i$, acting on the piston, given by $$F_i=\sigma_i \cdot A_i$$

for a reasonable time.

Since the forces on the piston rod of a linear compressor must balance, then:

$$m \cdot a+c \cdot v+k \cdot x+P \cdot A+F_i=0$$

where m is the piston mass c is the viscous drag coefficient k is the spring stiffness a is the piston acceleration x is the piston position P Pressure and $A_P$ Piston Area This can be rearranged to give the acceleration;

$$a=\frac{F_i+k \cdot x+c \cdot v+P \cdot A_k}{m}$$

Thus the collision force, $F_i$, significantly increases the deceleration of the piston and this is reflected in the shape of the back emf versus time curve i.e. the sudden change of slope shown in FIG. 2.

Conventional linear motors are designed so that there is a linear relation between back emf and velocity.

i.e. $\text{emf}=\alpha \cdot v$

Figure 4:
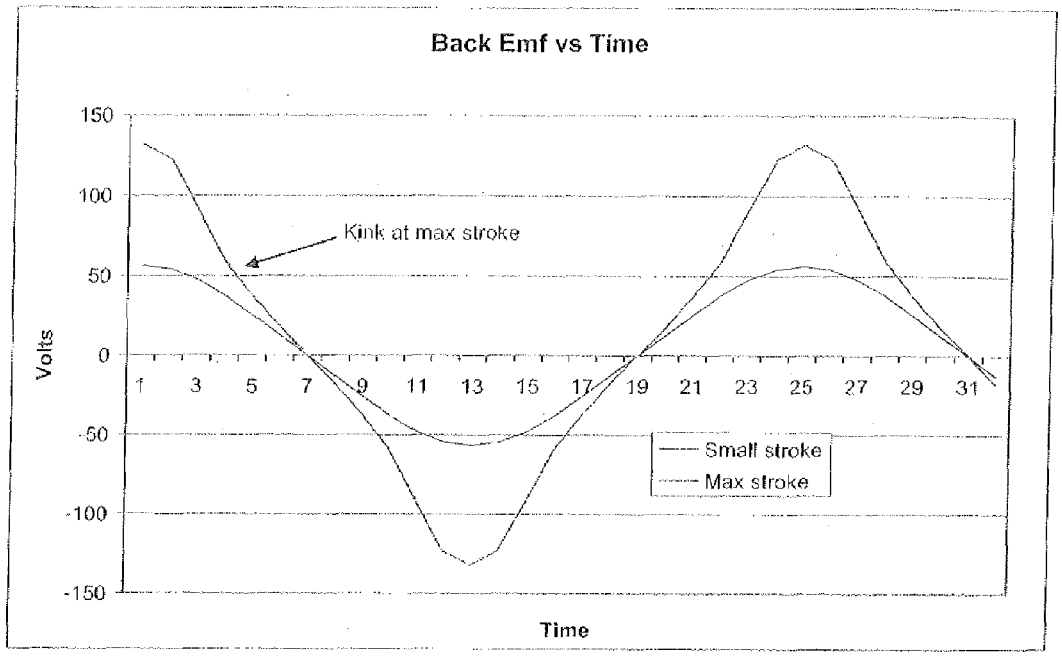
FIG. 4 is a graph of motor back EMF versus time for a small and a maximum stroke length in a first embodiment of the invention.

In contrast the "short stator" configuration of the preferred form of motor (disclosed in WO 00/79671) has a design where the value of $\alpha$ varies with the position i.e. $\text{emf}=f(x) \cdot v$ If the motor design is such that there is a "kink" or discontinuity in the function f(x), as shown by the arrow on FIG. 3, this kink will show up in the back emf curve at larger strokes. FIG. 4 shows the effect of the kink from FIG. 3 on the back emf curve as the stroke increases from 12 mm to 14 mm.

Figure 7:
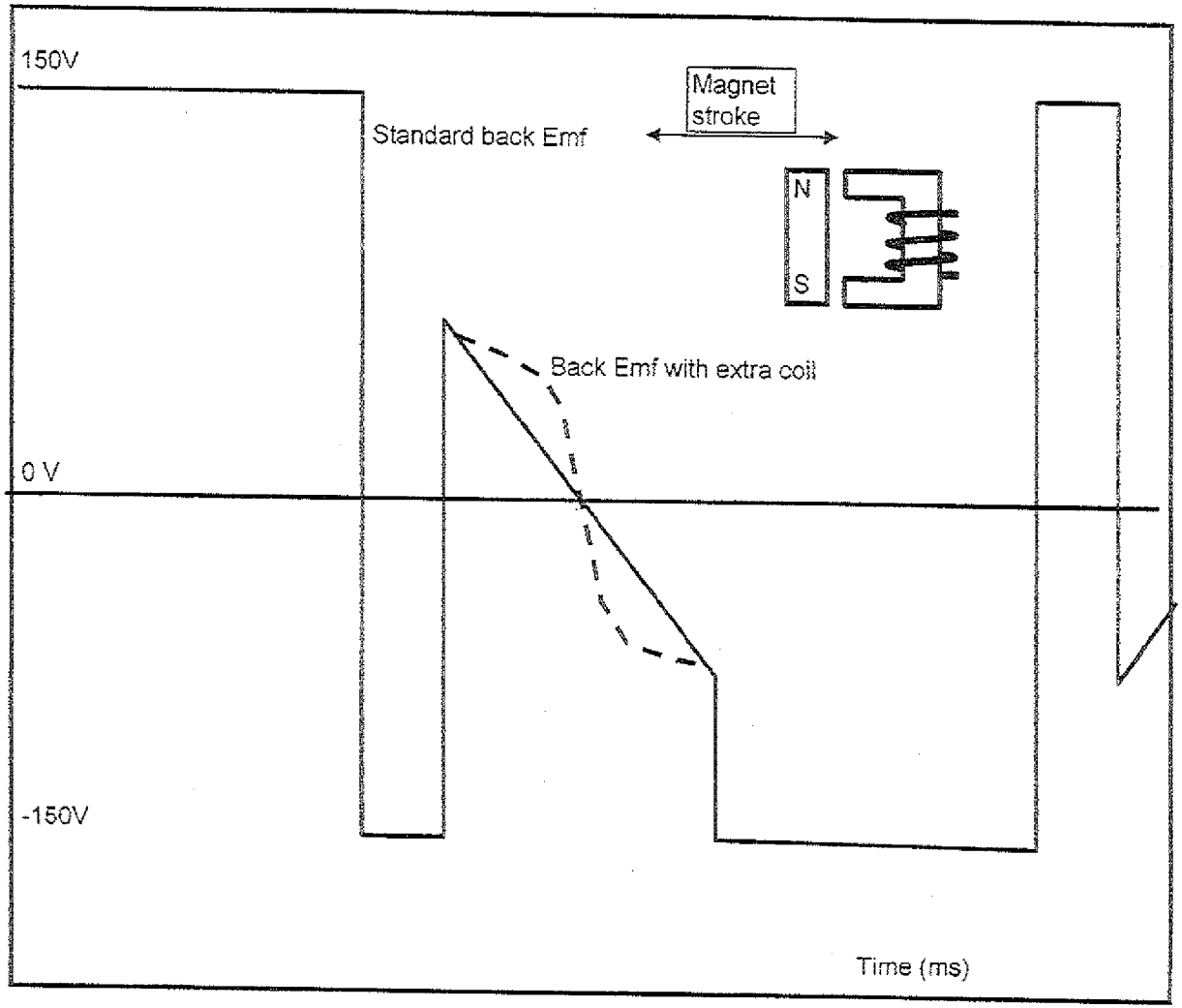
FIG. 7 is a graph of motor back EMF versus time in an alternative embodiment of the invention.

In an alternative embodiment (see FIG. 7) this kink can also be achieved by adding a sensing coil in series with the windings. This coil generates an emf only when a permanent magnet on the motor armature gets close to it. The magnet may be specifically for this purpose or it may be one of the existing magnets. This emf adds to the emf generated by the main windings just prior to the zero crossing as shown in FIG. 7.

Figure 5:
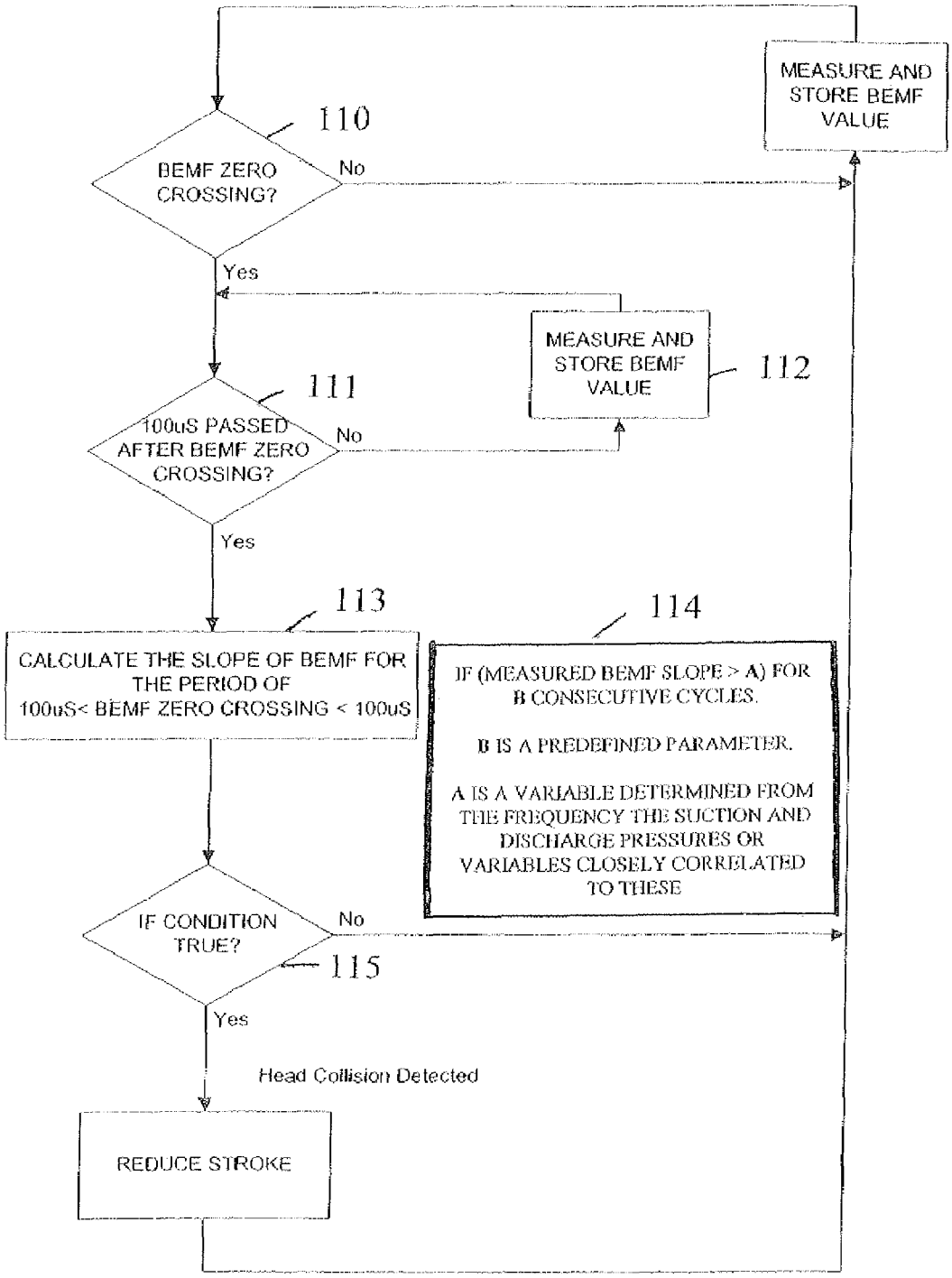
FIG. 5 is a flow chart of the collision detection avoidance process used in the invention.

A method for determining kinks or discontinuities in the back EMF induced in the stator windings of the motor and for the subsequent control of the motor input power to avoid piston collisions is illustrated in flowchart form in FIG. 5. In practice it is convenient to implement this method of control using a programmed microprocessor. The flowchart of FIG. 5 shows the essential logic of the processor program.

Figure 6:
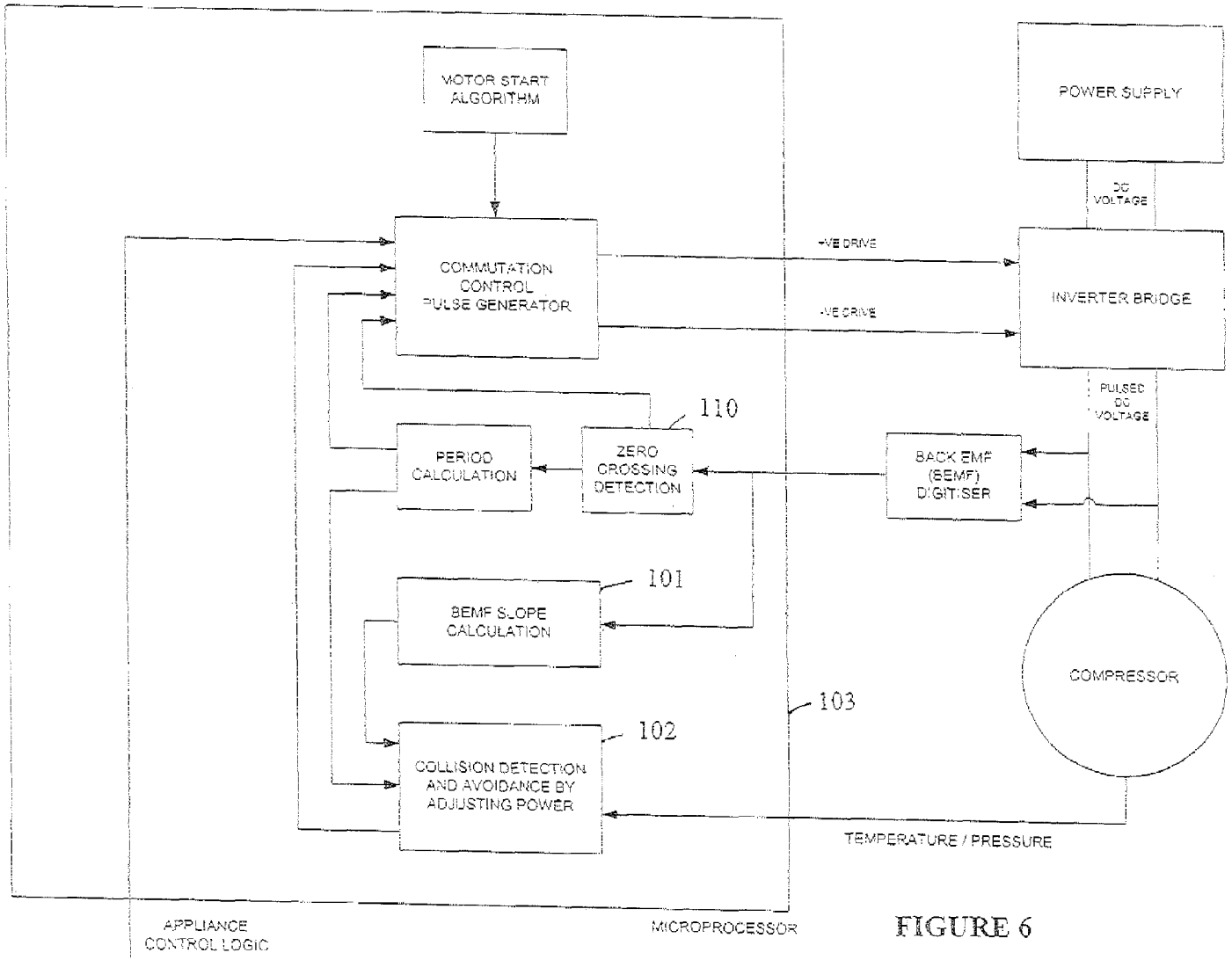
FIG. 6 is a block diagram of a controller employing the process of FIG. 5.

The motor and control system employing the present invention is shown in block diagram form in FIG. 6. The function of the present invention is encapsulated within block 101 which provides an input to the motor input power adjusting means 102 which is primarily controlled by the algorithm disclosed in WO 01/79671. The motor control of the present invention overrides the basic motor control algorithm only upon calculations indicating a collision or near collision of the piston.

Digitised back EMF signals are applied to an input of microprocessor 103 and routine determines 110 the times when the back EMF waveform is zero or a corresponding periodic value. If zero crossing is detected a decision is made 111 whether a sufficient period has passed following the instance of zero crossing. In the preferred embodiment this time period is 100 microseconds. If not then the back EMF value is measured and stored 112. If more than 100 microseconds has passed then sufficient data has been collected to calculate the slope of the back EMF curve over that 100 microsecond period 113. A routine 114 is then executed to determine if there has been any discontinuity in measured slope values. That is, if the slope departs from a value determined from the suction and discharge pressures (or variables which are well correlated with these parameters e.g. evaporating temperature and frequency) for a predetermined number of consecutive 100 microsecond cycles then a discontinuity is determined. Since this is indicative of a piston collision a signal is sent to power controller 102 to reduce input power and thereby reduce the stroke of the motor armature and piston to reduce the potential for collisions. The motor input power will be reduced incrementally and a number of iterations of the process described could take place in some instances before the slope discontinuity determining routine ceases to indicate a slope discontinuity and decision step 115 inhibits further signals to the motor input power controller.

By the above secondary control means and by employing a motor design for the compressor having the "short stator" configuration or the sensing coil technique previously referred to, piston collisions with the compression cylinder bead can be reduced and damage obviated.

It will also be appreciated the present invention is equally applicable to a range of applications. It is desirable in any free piston reciprocating linear motor to limit or control the maximum magnitude of reciprocation. For the present invention to be applied the system requires a restoring force eg: a spring system or gravity, causing reciprocation, and some change in the mechanical or electrical system which causes a change in the electrical reciprocation period when a certain magnitude of reciprocation is reached.

The invention claimed is:

1. A method of controlling the stroke of a fire piston linear compressor motor so as to minimise or avoid piston collisions at the extremities of said stroke comprising the steps of:

monitoring the motor back EMF, detecting zero-crossings of said motor back EMF, monitoring the slope of the back EMF waveform in the vicinity of said zero crossings, detecting discontinuities in the slope of said back EMF waveform, and incrementally reducing motor input power upon detection of a discontinuity in the slope of said back EMF waveform.

2. A method according to claim 1 wherein said slope monitoring comprises measuring and storing the value of the back EMF at predetermined intervals and calculating the slope of the back EMF waveform between successive predetermined intervals to produce succession of slope values.

3. A method according to claim 2 wherein said slope monitoring comprises comparing the latest measured slope with the measured slope at the same point in the immediately preceding cycle.

4. A method according to claim 2 wherein said slope monitoring comprises comparing the latest measured slope with the average of the measured slopes at the same point of a predetermined number of immediately preceding cycles.

5. A method according to claim 2 wherein discontinuities in back EMF waveform slope are detected by successively comparing each said calculated slope values with a predetermined value and if said predetermined value is exceeded over a predetermined number of slope values indicating a slope discontinuity.

6. A method according to claim 1 wherein back EMF slope discontinuities which are detected are those which represent an increase in slope on rising back EMF and a decrease in slope on falling back EMF.

7. A method according to claim 1 wherein back EMF slope discontinuities which are detected are those which represent an increase in slope on a falling back EMF.

8. A free piston linear compressor motor having a stroke controlled so as to minimise or avoid piston collisions at the extremities of said stroke comprising:

a linear motor having a wound stator and a co-acting armature which is mechanically coupled to said piston;

means for monitoring the motor hack EMF in the stator windings, means for detecting zero-crossings of said motor back EMF, means for determining the slope of the back EMF waveform in the vicinity of said detected zero crossings, means for determining discontinuities in the slope of said back EMF waveform, and a motor input power controller which supplies current to said stator windings and which has an input responsive to said discontinuity determining means, said controller reducing motor input power upon a discontinuity being determined in the slope of the back EMF waveform by said discontinuity determining means.

9. A motor according to claim 8 incorporating a program controlled processor which provides the means for determining slope and slope discontinuity and programmed to measure and store the value of the back EMF at predetermined intervals and calculate the slope of the back EMF waveform between successive predetermined intervals to produce succession of slope values.

10. A method according to claim 9 wherein said program successively compares each of said calculated slope values with a predetermined value and if said predetermined value is exceeded over a predetermined number of slope values indicate a slope discontinuity.

11. A method according to claim 8 wherein said program gives an indication back EMF slope discontinuities which represent an increase in slope on rising back EMF and a decrease in slope on falling back EMF.

12. A method according to claim 8 wherein said program gives an indication of back EMF slope discontinuities which are detected are those which represent an increase in slope on a falling back EMF.

* * * * *